US008662698B2

(12) United States Patent
Sagna et al.

(10) Patent No.: US 8,662,698 B2
(45) Date of Patent: Mar. 4, 2014

(54) FLAMELESS CANDLE CIRCUIT WITH MULTIPLE MODES

(75) Inventors: Benjamin Sagna, Montreal (CA); Frederic Boucher, Delson (CA)

(73) Assignee: Winvic Sales Inc., Markham, Ontario (CA)

( * ) Notice: Subject to any disclaimer, the term of this patent is extended or adjusted under 35 U.S.C. 154(b) by 414 days.

(21) Appl. No.: 13/184,724

(22) Filed: Jul. 18, 2011

(65) Prior Publication Data

US 2013/0020962 A1 Jan. 24, 2013

(51) Int. Cl.
*F21V 35/00* (2006.01)

(52) U.S. Cl.
USPC ..... 362/161; 362/249.02; 362/249.05; 362/569; 362/810; 315/217; 315/291; 315/297; 315/307; 315/360; 315/362

(58) Field of Classification Search
USPC ..... 362/161, 249.02, 249.05, 277, 392, 362/394, 447, 569, 810; 315/217, 225, 291, 315/297, 307, 308, 312, 313, 360, 362; 438/18
See application file for complete search history.

(56) References Cited

U.S. PATENT DOCUMENTS

| | | | | |
|---|---|---|---|---|
| 7,481,571 | B2 * | 1/2009 | Bistritzky et al. | 362/643 |
| 7,503,668 | B2 * | 3/2009 | Porchia et al. | 362/161 |
| 7,781,979 | B2 * | 8/2010 | Lys | 315/185 S |
| 7,824,627 | B2 * | 11/2010 | Michaels et al. | 422/128 |
| 7,828,462 | B2 * | 11/2010 | Jensen et al. | 362/249.02 |
| 7,997,772 | B2 * | 8/2011 | Avtzon et al. | 362/392 |
| 8,132,936 | B2 * | 3/2012 | Patton et al. | 362/249.02 |
| 8,282,251 | B2 * | 10/2012 | Fournier et al. | 362/392 |
| 8,412,029 | B2 * | 4/2013 | Browder et al. | 392/390 |
| 2003/0035291 | A1 | 2/2003 | Jensen et al. | |
| 2006/0115386 | A1 | 6/2006 | Michaels et al. | |
| 2007/0292812 | A1 | 12/2007 | Furner et al. | |

OTHER PUBLICATIONS

PCT Notification of Transmittal of the International Search Report and the Written Opinion of the International Searching Authority, or the Declaration, PCT/CA2012/000470, Oct. 12, 2012.
PCT Written Opinion of the International Searching Authority, PCT/CA2012/000470, Oct. 12, 2012.
PCT International Search Report, PCT/CA2012/000470, Oct. 12, 2012.

* cited by examiner

*Primary Examiner* — Haiss Philogene
(74) *Attorney, Agent, or Firm* — McAndrews, Held & Malloy, Ltd.

(57) ABSTRACT

According to embodiments of the present invention, a flameless candle circuit includes an application-specific integrated circuit ("ASIC") having a first power terminal, a second power terminal, and an output. The circuit also includes a light-emitting diode ("LED") and a single-pole switch. The LED is configured to receive a signal from the output of the ASIC. The single-pole switch is configured to selectively provide the battery voltage to at least one of the first power terminal and the second power terminal. Additionally, the single-pole switch is configured to remove the battery voltage from both of the first power terminal and the second power terminal to turn the ASIC off. The ASIC is configured to drive the LED in a first mode when the battery voltage is provided to the first power terminal. The ASIC is also configured to drive the LED in a second mode when the battery voltage is provided to the second power terminal.

40 Claims, 7 Drawing Sheets

FLAMELESS CANDLE CIRCUIT WITH MULTIPLE MODES

BACKGROUND OF THE INVENTION

Generally, the present application relates to flameless candle circuits. Particularly, the present application relates to flameless candle circuits that cause light emitting diode(s) ("LED") to generate light in two or more different modes.

Flameless candles may include a circuit (e.g., one or more circuits or sub-circuits) that drives one or more LEDs to generate light. Such a circuit may cause an LED to flicker, thereby creating an illusion of a flickering flame. The circuit may also include a timer that can automatically turn the LED off after a period of time. The timer may also turn the LED back on after another period of time.

FIG. 1 shows a schematic illustration of a prior art flameless candle circuit 100. The circuit 100 has a double-pole triple-throw switch ("2P3T switch") 110, a battery 120, an application specific integrated circuit ("ASIC") 130, an oscillator 140, an LED 150, and a resistor 160.

The circuit 100 generally operates in the following manner. The ASIC 130 has an output that intermittently provides a current through the resistor 160 and the LED 150. The current causes the LED 150 to emit light. By pulsing the current, it is possible to cause the LED 150 to flicker. An oscillator 140 regulates the timing functions of the ASIC 130. The ASIC 130 has an input that can be high or low. Depending on the state of the input, the ASIC 130 operates in two modes. One mode constantly drives the LED 150 causing it to flicker. The other mode drives the LED 150 for a period of time and then stops. After another period of time, the ASIC 130 will again drive the LED 150 and the cycle will repeat.

Power to the circuit 100 is provided by the battery 120. The selected mode of operation is determined by the state of the 2P3T switch 110. The 2P3T switch 110 has three different positions. When the 2P3T switch 110 is in the first position, the circuit 100 is turned off. Specifically, the negative terminal of the battery 120 is disconnected from ground, causing it to float. Consequently, current can no longer flow to through the battery 120 thereby shutting off the power to the ASIC 130.

When the 2P3T switch 110 is in the second position, the circuit 100 is turned on. Specifically, the negative terminal of the battery 120 is connected to ground, thereby allowing current to flow through the battery and provide power to the ASIC 130. Furthermore, the ASIC 130 is configured to provide a signal through the output to flickeringly drive the LED 150. Additionally, a high signal is applied to the input of the ASIC 130. This causes the ASIC 130 to recognize that a timer should be implemented. Accordingly, the ASIC 130 will shut off the LED 150 after a period of time and then back on after another period of time.

When the 2P3T switch 110 is in the third position, the circuit 100 is turned on. Specifically, the negative terminal of the battery 120 is connected to ground, thereby allowing current to flow through the battery and provide power to the ASIC 130. Furthermore, the ASIC 130 is configured to provide a signal through the output to flickeringly drive the LED 150. Additionally, a low signal is applied to the input of the ASIC 130 (for example, there may be a pull-down resistor on the input line). This causes the ASIC 130 to recognize that no timer should be implemented. Accordingly, the ASIC 130 will constantly and flickeringly drive the LED 150.

The circuit 100, however, requires the relatively expensive 2P3T switch 110. In addition to the part cost, the 2P3T switch 110 requires relatively complex wiring, thereby increasing material costs again. Furthermore, such a component may take up more space on a printed-circuit board or in other dimensions. Therefore, a simplified, compact, and less-expensive circuit is needed.

BRIEF SUMMARY OF THE INVENTION

According to embodiments of the present invention, a flameless candle circuit includes an ASIC having a first power terminal, a second power terminal, and an output. The circuit also includes an LED and a single-pole switch. The LED is configured to receive a signal from the output of the ASIC. The single-pole switch is configured to selectively provide a battery voltage to at least one of the first power terminal and the second power terminal. Additionally, the single-pole switch is configured to remove the battery voltage from both of the first power terminal and the second power terminal to turn the ASIC off. The ASIC is configured to drive the LED in a first mode when the battery voltage is provided to the first power terminal. The ASIC is also configured to drive the LED in a second mode when the battery voltage is provided to the second power terminal.

The ASIC may be configured to constantly provide a flickering signal to the LED in the first mode. The ASIC may also be configured to intermittently provide a flickering signal to the LED according to a slow timer in the second mode. One example of a slow timer is a repeating 24-hour cycle timer. Using such a timer, the ASIC may provide a flickering signal for 5 hours and turn off the flickering signal for 19 hours during one cycle of the repeating 24-hour cycle.

The ASIC may also be configured to drive the LED in a third mode when the battery voltage is provided to both the first power terminal and the second power terminal. In the third mode, the ASIC may intermittently provide a signal to the LED according to a fast timer. For example, the ASIC may cause the LED to blink for a predetermined number of times (e.g., 5 times) during a predetermined period of time (e.g., 5 seconds) such that an accuracy of the slow timer can be determined.

The single-pole switch may be a single-pole, triple-throw switch including three positions. When in the first position, the single-pole switch may be configured to provide the battery voltage to the first power terminal but not the second power terminal of the ASIC. When in the first position, the single-pole switch may be configured to provide the battery voltage to second first power terminal but not the first power terminal of the ASIC. When in the first position, the single-pole switch may be configured to remove the battery voltage from the first power terminal and the second power terminal of the ASIC.

The single-pole switch may be a slide switch. The single-pole switch may have an input terminal configured to receive the battery voltage, a first output terminal electrically connected to the first power terminal of the ASIC, and a second output terminal electrically connected to the second power terminal of the ASIC.

According to embodiments of the present invention, method for operation of a flameless candle circuit includes operating an ASIC in a first manner by using a single-pole switch to apply a battery voltage to a first power terminal of the ASIC, and remove the battery voltage from a second power terminal of the ASIC. When operating in the first manner, the LED is driven in a first mode. The method also includes operating the ASIC in a second manner by using the single-pole switch to apply the battery voltage to the second power terminal of the ASIC and remove the battery voltage from the first power terminal of the ASIC. When operating in the second manner, the LED is driven in a second mode. The method further includes turning off the flameless candle circuit by using the single-pole switch to remove the battery voltage from the first power terminal of the ASIC, and remove the battery voltage from the second power terminal of the ASIC.

As discussed above in the flameless candle circuit embodiments, the ASIC may be configured to constantly provide a flickering signal to the LED in the first mode. The ASIC may also be configured to intermittently provide a flickering signal to the LED according to a slow timer in the second mode. One example of a slow timer is a repeating 24-hour cycle timer. Using such a timer, the ASIC may provide a flickering signal for 5 hours and turn off the flickering signal for 19 hours during one cycle of the repeating 24-hour cycle.

According to an embodiment, the method further includes operating the ASIC in a third manner by applying the battery voltage to both the first power terminal and the second power terminal of the ASIC. In this embodiment, the LED is driven in a third mode while operating the ASIC in the third manner. The third mode further may include intermittently providing a signal from the ASIC to the LED according to a fast timer. For example, an LED may be blinked for a predetermined number of times (e.g., 5 times) during a predetermined period of time (e.g., 5 seconds) to determine an accuracy of the slow timer.

According to additional embodiments of the method, the step of operating the ASIC in a first matter includes switching the single-pole, triple-throw switch into a first position. The step of operating an ASIC in a second manner includes switching the single-pole, triple-throw switch into a second position. Additionally, the step of turning off the flameless candle circuit includes switching the single-pole, triple-throw switch into a third position.

According to embodiments of the present invention, a flameless candle circuit includes an ASIC having a first ground terminal, a second ground terminal, and an output. The circuit also includes an LED and a single-pole switch. The LED is configured to receive a signal from the output of the ASIC. The single-pole switch is configured to selectively connect ground to at least one of the first ground terminal and the ground terminal. Additionally, the single-pole switch is configured to disconnect ground from both of the first ground terminal and the second ground terminal to turn the ASIC off. The ASIC is configured to drive the LED in a first mode when ground is connected to the first ground terminal. The ASIC is also configured to drive the LED in a second mode when ground is connected to the second ground terminal.

The ASIC may be configured to constantly provide a flickering signal to the LED in the first mode. The ASIC may also be configured to intermittently provide a flickering signal to the LED according to a slow timer in the second mode. One example of a slow timer is a repeating 24-hour cycle timer. Using such a timer, the ASIC may provide a flickering signal for 5 hours and turn off the flickering signal for 19 hours during one cycle of the repeating 24-hour cycle.

The ASIC may also be configured to drive the LED in a third mode when ground is connected to both the first ground terminal and the second ground terminal. In the third mode, the ASIC may intermittently provide a signal to the LED according to a fast timer. For example, the ASIC may cause the LED to blink for a predetermined number of times (e.g., 5 times) during a predetermined period of time (e.g., 5 seconds) such that an accuracy of the slow timer can be determined.

The single-pole switch may be a single-pole, triple-throw switch including three positions. When in the first position, the single-pole switch may be configured to connect ground to the first ground terminal but not the second ground terminal of the ASIC. When in the first position, the single-pole switch may be configured to connect ground to second first ground terminal but not the first ground terminal of the ASIC. When in the first position, the single-pole switch may be configured to disconnect ground from the first ground terminal and the second ground terminal of the ASIC.

The single-pole switch may be a slide switch. The single-pole switch may have an input terminal connected to ground, a first output terminal electrically connected to the first ground terminal of the ASIC, and a second output terminal electrically connected to the second ground terminal of the ASIC.

According to embodiments of the present invention, method for operation of a flameless candle circuit includes operating an ASIC in a first manner by using a single-pole switch to connect ground to a first ground terminal of the ASIC, and disconnect ground from a second ground terminal of the ASIC. When operating in the first manner, the LED is driven in a first mode. The method also includes operating the ASIC in a second manner by using the single-pole switch to connect ground to the second ground terminal of the ASIC and disconnect ground the battery voltage from the first ground terminal of the ASIC. When operating in the second manner, the LED is driven in a second mode. The method further includes turning off the flameless candle circuit by using the single-pole switch to disconnect ground from the first ground terminal of the ASIC, and disconnect ground from the second ground terminal of the ASIC.

As discussed above in the flameless candle circuit embodiments, the ASIC may be configured to constantly provide a flickering signal to the LED in the first mode. The ASIC may also be configured to intermittently provide a flickering signal to the LED according to a slow timer in the second mode. One example of a slow timer is a repeating 24-hour cycle timer. Using such a timer, the ASIC may provide a flickering signal for 5 hours and turn off the flickering signal for 19 hours during one cycle of the repeating 24-hour cycle.

According to an embodiment, the method further includes operating the ASIC in a third manner by connecting ground to both the first ground terminal and the second ground terminal of the ASIC. In this embodiment, the LED is driven in a third mode while operating the ASIC in the third manner. The third mode further may include intermittently providing a signal from the ASIC to the LED according to a fast timer. For example, an LED may be blinked for a predetermined number of times (e.g., 5 times) during a predetermined period of time (e.g., 5 seconds) to determine an accuracy of the slow timer.

According to additional embodiments of the method, the step of operating the ASIC in a first matter includes switching the single-pole, triple-throw switch into a first position. The step of operating an ASIC in a second manner includes switching the single-pole, triple-throw switch into a second position. Additionally, the step of turning off the flameless candle circuit includes switching the single-pole, triple-throw switch into a third position.

Figure 1:
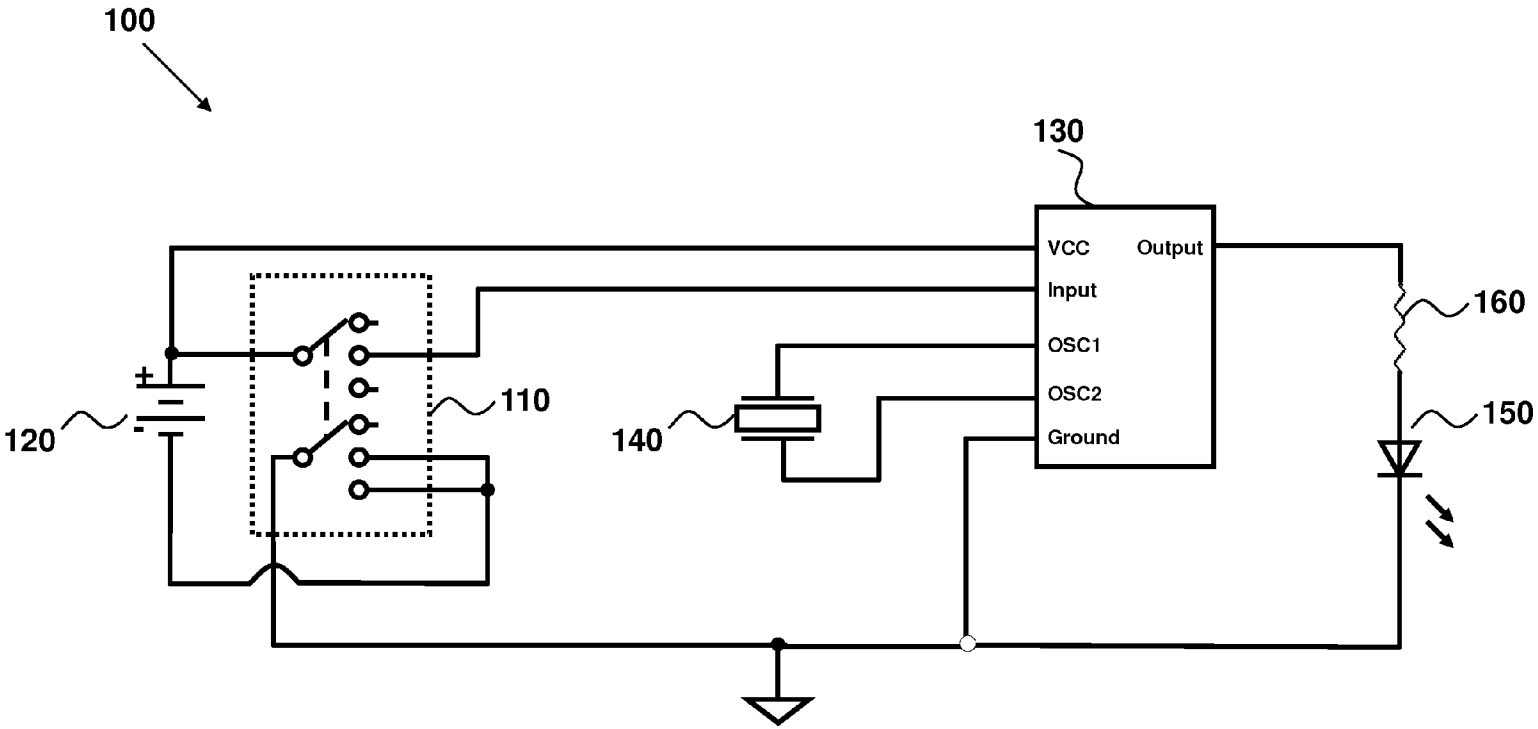
Figure 1 (Prior Art)
FIG. 1 shows a schematic illustration of a prior art flameless candle circuit.

The foregoing summary, as well as the following detailed description of certain embodiments of the present invention, will be better understood when read in conjunction with the appended drawings. For the purposes of illustration, certain embodiments are shown in the drawings. It should be understood, however, that the claims are not limited to the arrangements and instrumentality shown in the attached drawings. Furthermore, the appearance shown in the drawings is one of many ornamental appearances that can be employed to achieve the stated functions of the system.

DETAILED DESCRIPTION OF THE INVENTION

Figure 2:
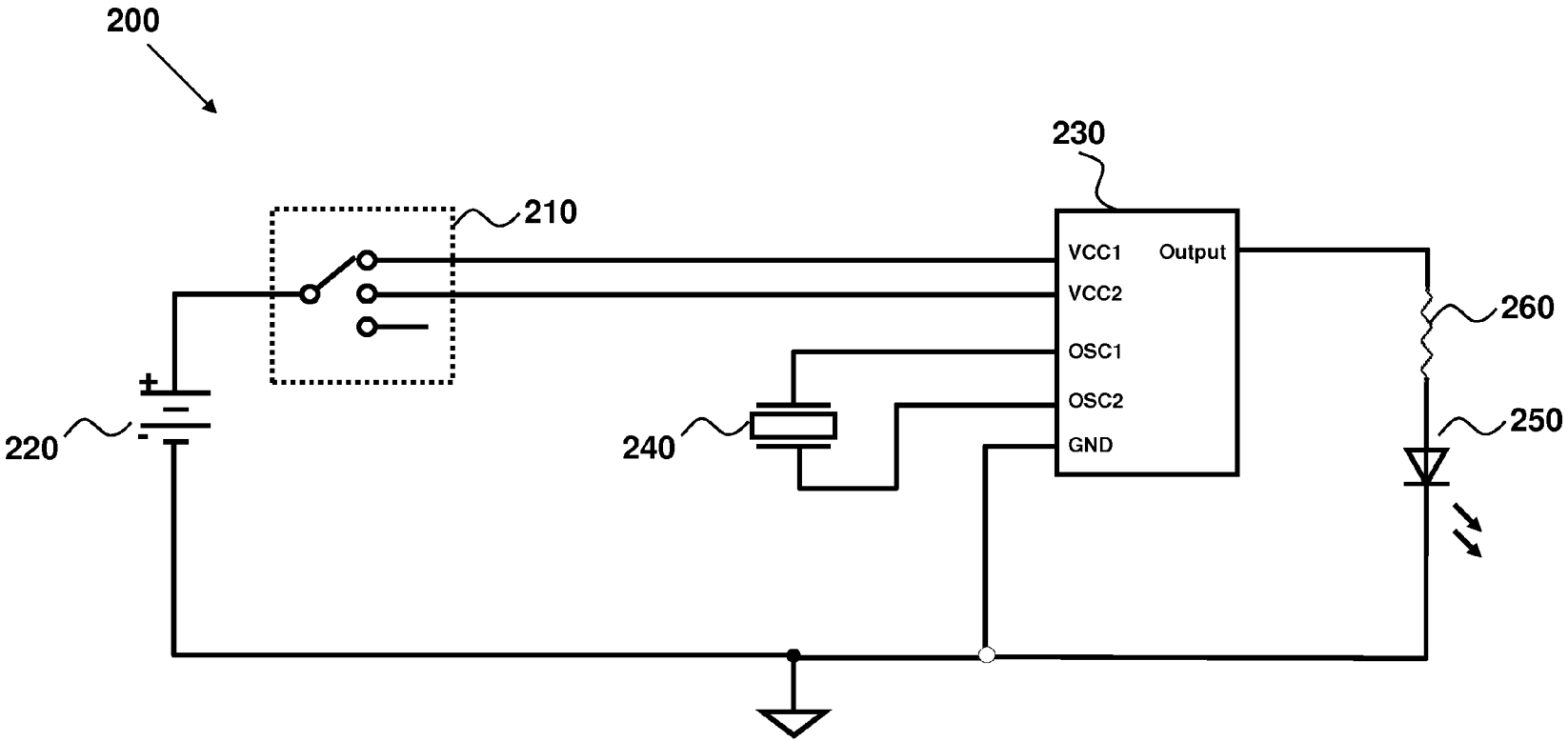
FIG. 2 shows a schematic illustration of a flameless candle circuit, according to an embodiment of the present invention.

FIG. 2 shows a schematic illustration of a flameless candle circuit 200, according to an embodiment of the present invention. The circuit 200 includes a single-pole, triple-throw switch 210, a battery 220, an application specific integrated circuit ("ASIC") 230, an oscillator 240, an LED 250, and a resistor 260. The ASIC 230 includes the following pins or terminals: output, ground, oscillator 1 ("OSC1"), oscillator 2 ("OSC2). Also, instead of having only one power terminal like processor 130, the processor 230 has two power terminals—a first power terminal ("VCC1") and a second power terminal ("VCC2").

The circuit 200 generally operates in the following manner. The oscillator 240 regulates the timing functions of the ASIC 230. The ASIC 230 has an output that can provide a signal to the resistor 260 (e.g., current-limiting resistor) and the LED 250. The signal causes a current to flow through the LED 250, which then emits light. The switch 210 may be a single-pole switch. The switch 210 may be a single-pole, triple-throw switch. Other types of single-pole switches are also possible—e.g., double-throw, quadruple-throw, etc. The switch 210 may be a slide switch or another variety.

If the switch 210 is a single-pole, triple-throw switch (as shown in FIG. 2), it may include an input terminal, a first output terminal, a second output terminal, and a third output terminal. The switch 210 may also have three corresponding positions—a first position, a second position, and a third position. The switch 210 may be selectively moved to one of the three positions. The first position may cause an electrical connection between the input terminal and the first output terminal (but not the second and third output terminals). The second position may cause an electrical connection between the input terminal and the second output terminal (but not the first and third output terminals). The third position may cause an electrical connection between the input terminal and the third output terminal (but not the first and second output terminals).

The input terminal may be electrically connected to the battery 220 and configured to receive a battery voltage. The first output terminal may be electrically connected to VCC1 on the ASIC 230. The second output terminal may be electrically connected to VCC2 on the ASIC 230. The third output terminal may be floating or not connected—e.g., forming an open circuit. The third output terminal may otherwise be connected or arranged to prevent the circuit 200 from operating. Of course, the switch may be arranged differently—e.g., the first output may be connected to VCC2, the second output may be connected to VCC1, etc. Such modifications are within the scope of the present invention.

With such an arrangement, it may be possible to selectively provide the battery voltage to VCC1, VCC2, or to neither of VCC1 and VCC2 (e.g., remove the battery voltage from VCC1 and VCC2) according to the position of the switch 210. When the switch 210 is in the first position, the battery voltage is provided to VCC1 but not to VCC2. The ASIC 230 may receive power through VCC1 and operate in a first manner. When the switch 210 is in the second position, the battery voltage may be provided to VCC2 but not to VCC1. The ASIC 230 may receive power through VCC2 and operate in a second manner. When the switch 210 is in the third position, the battery voltage may be removed from both VCC2 and VCC1. The ASIC 230 may no longer receive power and consequently may cease its operation.

When operating in the first manner, the ASIC 230 may drive the LED 250 in a first mode. The ASIC 230 may drive the LED 250 through its output terminal. In the first mode, the ASIC 230 may constantly provide a flickering signal to the LED. By pulsing the flickering, it is possible to cause the LED 250 to flicker.

The flickering may be caused by rapidly strobing the LED 250 to create different degrees of perceptible light intensity. The different intensities may be strung together to create an illusion of a flickering candle flame. The signal may be a pulse-width modulated ("PWM") signal created by the ASIC 230. By changing the duty cycle of the PWM signal, different apparent light intensities from the LED 250 may be achieved—e.g., higher duty cycles result in higher apparent light intensities from the LED 250 and lower duty cycles result in lower apparent light intensities from the LED 250.

When operating in the second manner, the ASIC 230 may drive the LED 250 in a second mode. The ASIC 230 may drive the LED 250 through its output terminal. In the second mode, the ASIC 230 may intermittently provide a flickering signal to the LED. The second mode may be implemented with a slow timer. One example of a slow timer is a timer having a 24-hour full cycle. The full cycle may repeat—one full cycle per 24 hours. During the cycle, the flickering signal may be driven for a first period of time and turned off for a second period of time. The first period of time may be less than the second period of time. The first period of time may be 5 hours, approximately. The second period of time may be 19 hours, approximately.

The ASIC 230 may also be configured to operate in a third manner. For example, the battery voltage may be applied to both VCC1 and VCC2 and the third manner of operation may result. The battery voltage may be applied to VCC1 and VCC2 by a circuit configuration or addition that is not shown in FIG. 2. For example, a jumper could be placed between VCC1 and VCC2. An additional switch position may be added to implement the application of the battery voltage to both VCC1 and VCC2. The third manner of operation may be used for testing—for example, to test the accuracy of the slow timer.

While operating in the third manner, the ASIC 230 may drive the LED 250 in a third mode. During the third mode, a signal (either flickering or non-flickering) may be provided from the ASIC 230 to the LED 250 using a fast timer. The fast timer may have a full cycle on the order of seconds or minutes and may be relatively fast (compared to the slow timer). The third mode may cause the LED 250 to blink for a predetermined number of times over a predetermined period of time (e.g., 5 blinks in 5 seconds). A user, for example, may count and time the LED 250 to see if an expected number of blinks (e.g., 5 blinks) occur within the predetermined period of time (e.g., 5 seconds). If the counted number of blinks is equal to the predetermined number of blinks during the predetermined period of time, then the slow timer may be deemed to be functioning properly—e.g., having a full cycle of expected duration (e.g., 24-hour full cycle). Otherwise there may be a problem with the accuracy of the slow timer.

Figure 4:
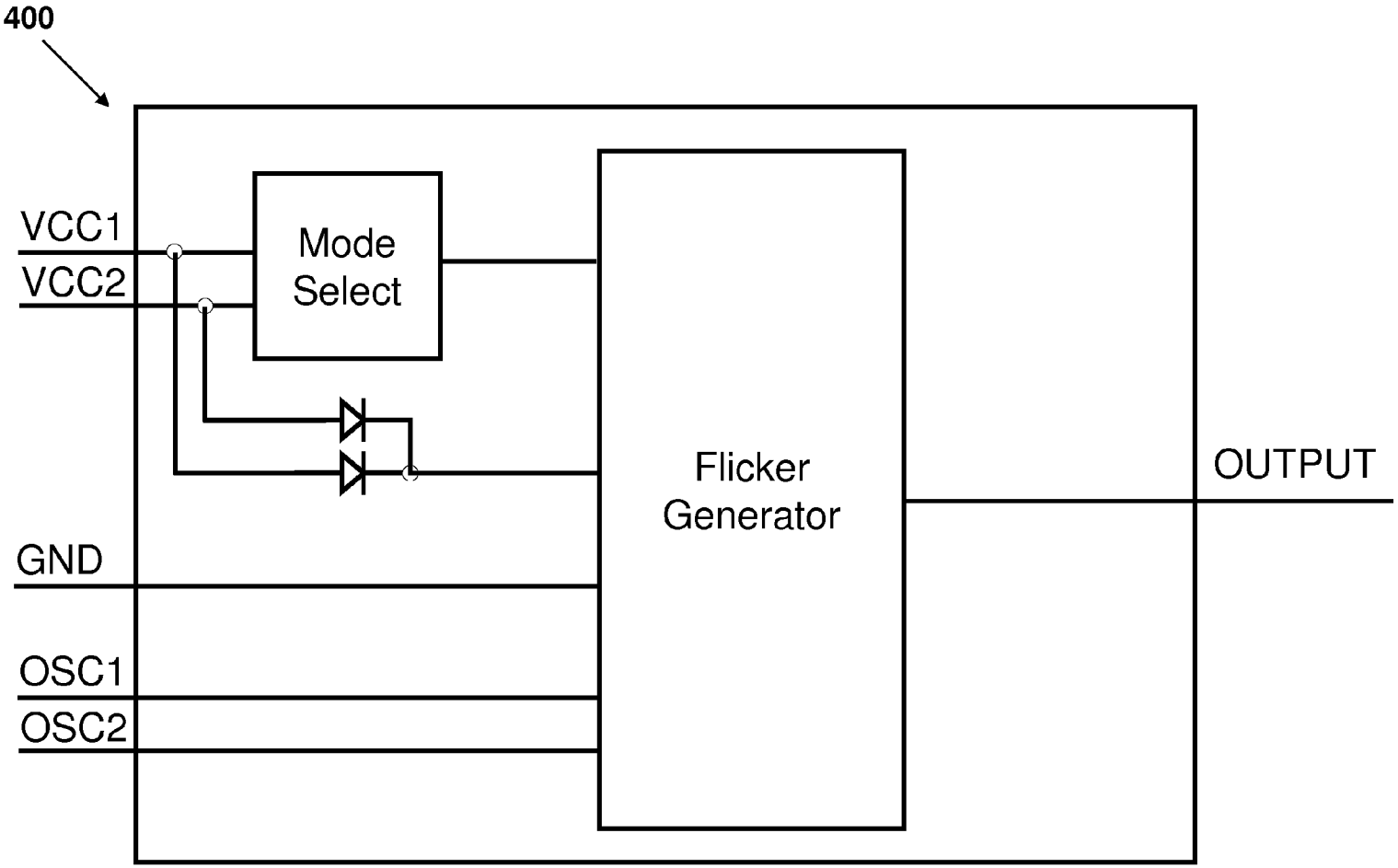
FIG. 4 shows a schematic illustration of an ASIC for use in a flameless candle circuit, according to an embodiment of the present invention.

FIG. 4 shows a schematic illustration of an ASIC 400 for use in a flameless candle circuit, according to an embodiment of the present invention. The ASIC 400 may be similar to ASIC 230. As shown, the ASIC has two power terminals VCC1 and VCC2, as well as two oscillator inputs OSC1 and OSC2. Both power terminals are connected to a single power bus. As shown, both power terminals are connected through two diodes, but other circuit designs are also possible. Power from one or both of VCC1 and VCC2 is supplied to the flicker generator, or any other component of the ASIC (for example, a component used for testing the ASIC) according to design preferences. The flicker generator may include additional components, such as dividers, decoders, volatile and/or non-volatile memor(ies), comparators, timers, or the like. The mode of operation of the flicker generator may be determined through the mode select block according to whether power is supplied through VCC1 and/or VCC2.

Figure 3:
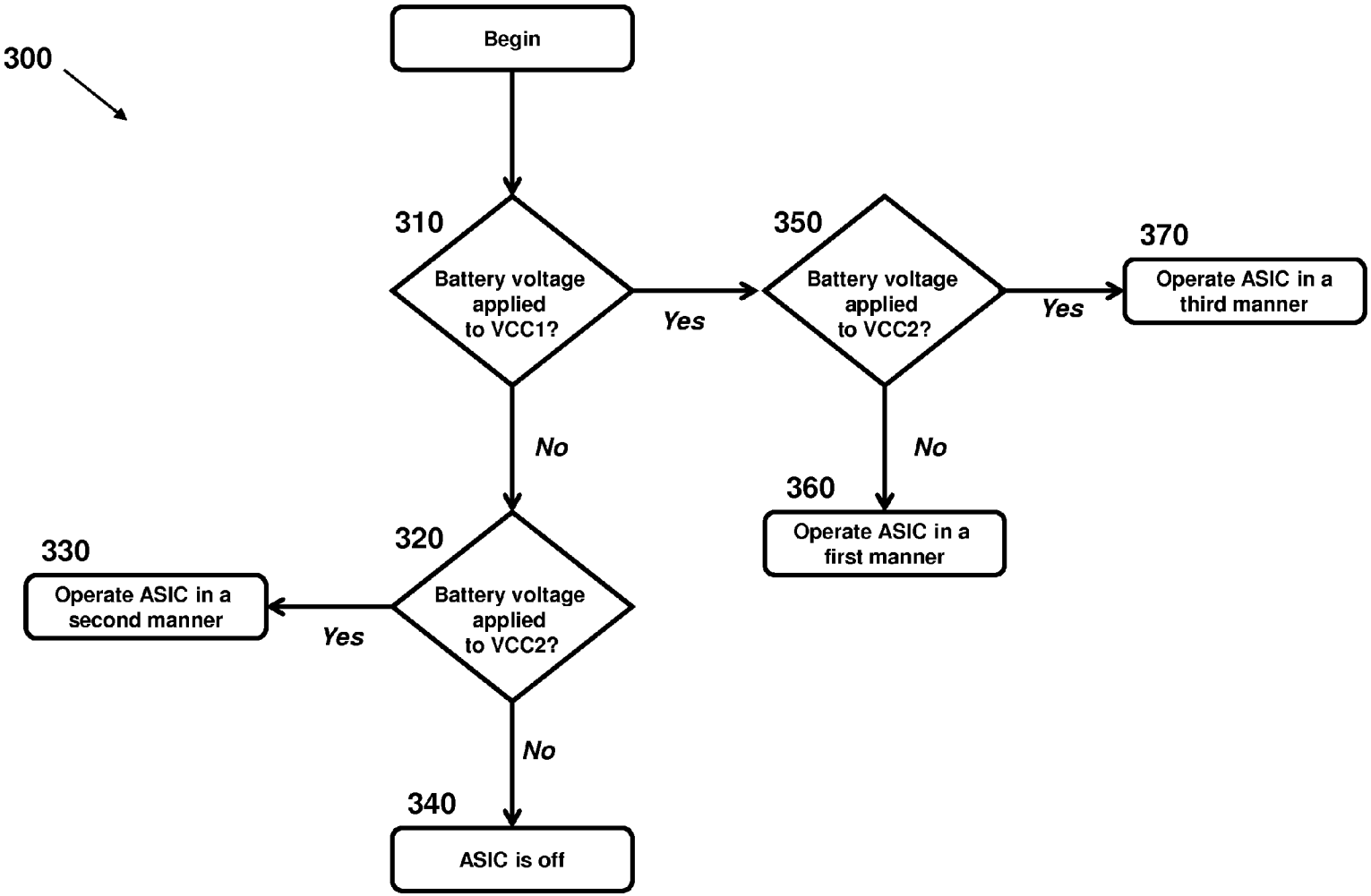
FIG. 3 shows a flowchart for a method of operating a flameless candle circuit, according to an embodiment of the present invention.

FIG. 3 shows a flowchart 300 for a method of operating a flameless candle circuit, according to an embodiment of the present invention. Some steps illustrated in the flowchart 300 may be performable in a different order, simultaneously, or some steps may be omitted according to preferences.

The flow begins and at step 310, the flow is routed step 350 if a battery voltage is applied to VCC1. At step 350, the flow is routed to one of steps 360 or 370 according to whether the battery voltage is applied to VCC2. If the battery voltage is not applied to VCC2, then the ASIC operates in a first manner—e.g., as described above in conjunction with circuit 200. If the battery voltage is applied to VCC2, then the ASIC operates in a third manner—e.g., as described above in conjunction with circuit 200.

Going back to step 310, the flow is routed step 320 if the battery voltage is not applied to VCC1. At step 320, the flow is routed to one of steps 330 or 340 according to whether the battery voltage is applied to VCC2. If the battery voltage is applied to VCC2, then the flow proceeds to step 330 at which the ASIC is operated in a second manner—e.g., as described above in conjunction with circuit 200. If the battery voltage is not applied to VCC2, then the flow proceeds to step 340 at which the ASIC is off—e.g., as described above in conjunction with circuit 200.

Figure 5:
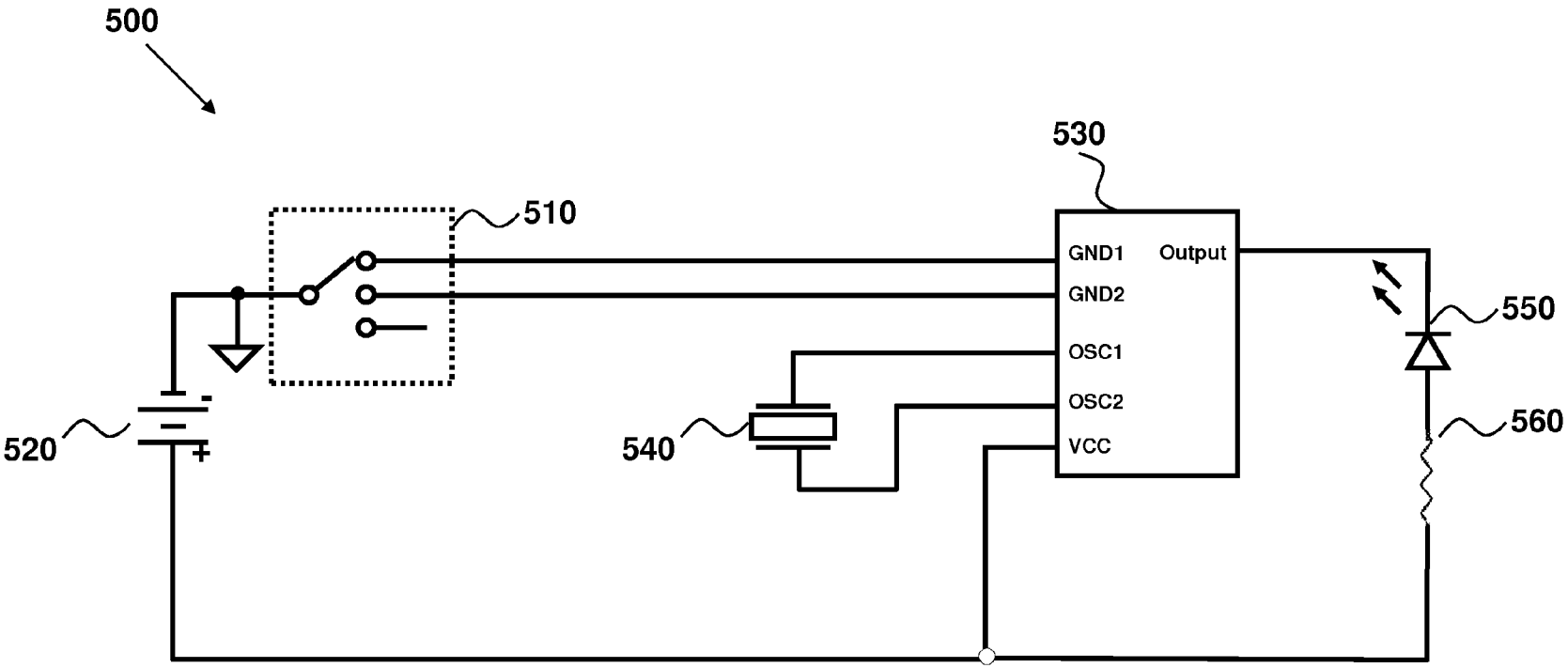
FIG. 5 shows a schematic illustration of a flameless candle circuit, according to an embodiment of the present invention.

FIG. 5 shows a schematic illustration of a flameless candle circuit 500, according to an embodiment of the present invention. The circuit 500 includes a single-pole, triple-throw switch 510, a battery 520, an application specific integrated circuit ("ASIC") 530, an oscillator 540, an LED 550, and a resistor 560. The ASIC 530 includes the following pins or terminals: output, ground, oscillator 1 ("OSC1"), oscillator 2 ("OSC2). Also, instead of having only one ground terminal like processor 130, the processor 530 has two ground terminals—a first ground terminal ("GND1") and a second ground terminal ("GND2").

The circuit 500 generally operates in the following manner. The oscillator 540 regulates the timing functions of the ASIC 530. The ASIC 530 has an output that can provide a signal to the resistor 560 (e.g., current-limiting resistor) and the LED 550. The signal causes a current to flow through the LED 550, which then emits light. The switch 510 may be a single-pole switch. The switch 510 may be a single-pole, triple-throw switch. Other types of single-pole switches are also possible—e.g., double-throw, quadruple-throw, etc. The switch 510 may be a slide switch or another variety.

If the switch 510 is a single-pole, triple-throw switch (as shown in FIG. 5), it may include an input terminal, a first output terminal, a second output terminal, and a third output terminal. The switch 510 may also have three corresponding positions—a first position, a second position, and a third position. The switch 510 may be selectively moved to one of the three positions. The first position may cause an electrical connection between the input terminal and the first output terminal (but not the second and third output terminals). The second position may cause an electrical connection between the input terminal and the second output terminal (but not the first and third output terminals). The third position may cause an electrical connection between the input terminal and the third output terminal (but not the first and second output terminals).

The input terminal may be electrically connected to the negative terminal of the battery 520 or ground. As used herein, the term "ground" can encompass the negative terminal of the battery, earth ground, signal ground, and/or the like. The first output terminal may be electrically connected to GND1 on the ASIC 530. The second output terminal may be electrically connected to GND2 on the ASIC 530. The third output terminal may be floating or not connected—e.g., forming an open circuit. The third output terminal may otherwise be connected or arranged to prevent the circuit 500 from operating. Of course, the switch may be arranged differently—e.g., the first output may be connected to GND2, the second output may be connected to GND1, etc. Such modifications are within the scope of the present invention.

With such an arrangement, it may be possible to selectively connect ground or the negative terminal of the battery to GND1, GND2, or to neither of GND1 and GND2 according to the position of the switch 510. When the switch 510 is in the first position, ground is connected to GND1 but not to GND2. In this scenario, the ASIC 530 may operate in a first manner. When the switch 510 is in the second position, ground is connected to GND2 but not to GND1. In this scenario, the ASIC 530 may operate in a second manner. When the switch 510 is in the third position, the ground may be disconnected from both GND1 and GND2. In this scenario, the ASIC 530 may no longer receive power and consequently may cease operating.

When operating in the first manner, the ASIC 530 may drive the LED 550 in a first mode. The ASIC 530 may drive the LED 550 through its output terminal. In the first mode, the ASIC 530 may constantly provide a flickering signal to the LED. By pulsing the flickering, it is possible to cause the LED 550 to flicker.

The flickering may be caused by rapidly strobing the LED 550 to create different degrees of perceptible light intensity. The different intensities may be strung together to create an illusion of a flickering candle flame. The signal may be a pulse-width modulated ("PWM") signal created by the ASIC 530. By changing the duty cycle of the PWM signal, different apparent light intensities from the LED 550 may be achieved—e.g., higher duty cycles result in higher apparent light intensities from the LED 550 and lower duty cycles result in lower apparent light intensities from the LED 550.

When operating in the second manner, the ASIC 530 may drive the LED 550 in a second mode. The ASIC 530 may drive the LED 550 through its output terminal. In the second mode, the ASIC 530 may intermittently provide a flickering signal to the LED. The second mode may be implemented with a slow timer. One example of a slow timer is a timer having a 24-hour full cycle. The full cycle may repeat—one full cycle per 24 hours. During the cycle, the flickering signal may be driven for a first period of time and turned off for a second period of time. The first period of time may be less than the second period of time. The first period of time may be 5 hours, approximately. The second period of time may be 19 hours, approximately.

The ASIC 530 may also be configured to operate in a third manner. For example, the ground may be connected to both GND1 and GND2 and the third manner of operation may result. The ground may be connected to both GND1 and GND2 by a circuit configuration or addition that is not shown in FIG. 5. For example, a jumper could be placed between GND1 and GND2. As another example, an additional switch position may be added to connect the ground to both GND1 and GND2. The third manner of operation may be used for testing—for example, to test the accuracy of the slow timer.

While operating in the third manner, the ASIC 530 may drive the LED 550 in a third mode. During the third mode, a signal (either flickering or non-flickering) may be provided from the ASIC 530 to the LED 550 using a fast timer. The fast timer may have a full cycle on the order of seconds or minutes and may be relatively fast (compared to the slow timer). The third mode may cause the LED 550 to blink for a predetermined number of times over a predetermined period of time (e.g., 5 blinks in 5 seconds). A user, for example, may count and time the LED 550 to see if an expected number of blinks (e.g., 5 blinks) occur within the predetermined period of time (e.g., 5 seconds). If the counted number of blinks is equal to the predetermined number of blinks during the predetermined period of time, then the slow timer may be deemed to be functioning properly—e.g., having a full cycle of expected duration (e.g., 24-hour full cycle). Otherwise there may be a problem with the accuracy of the slow timer.

Figure 7:
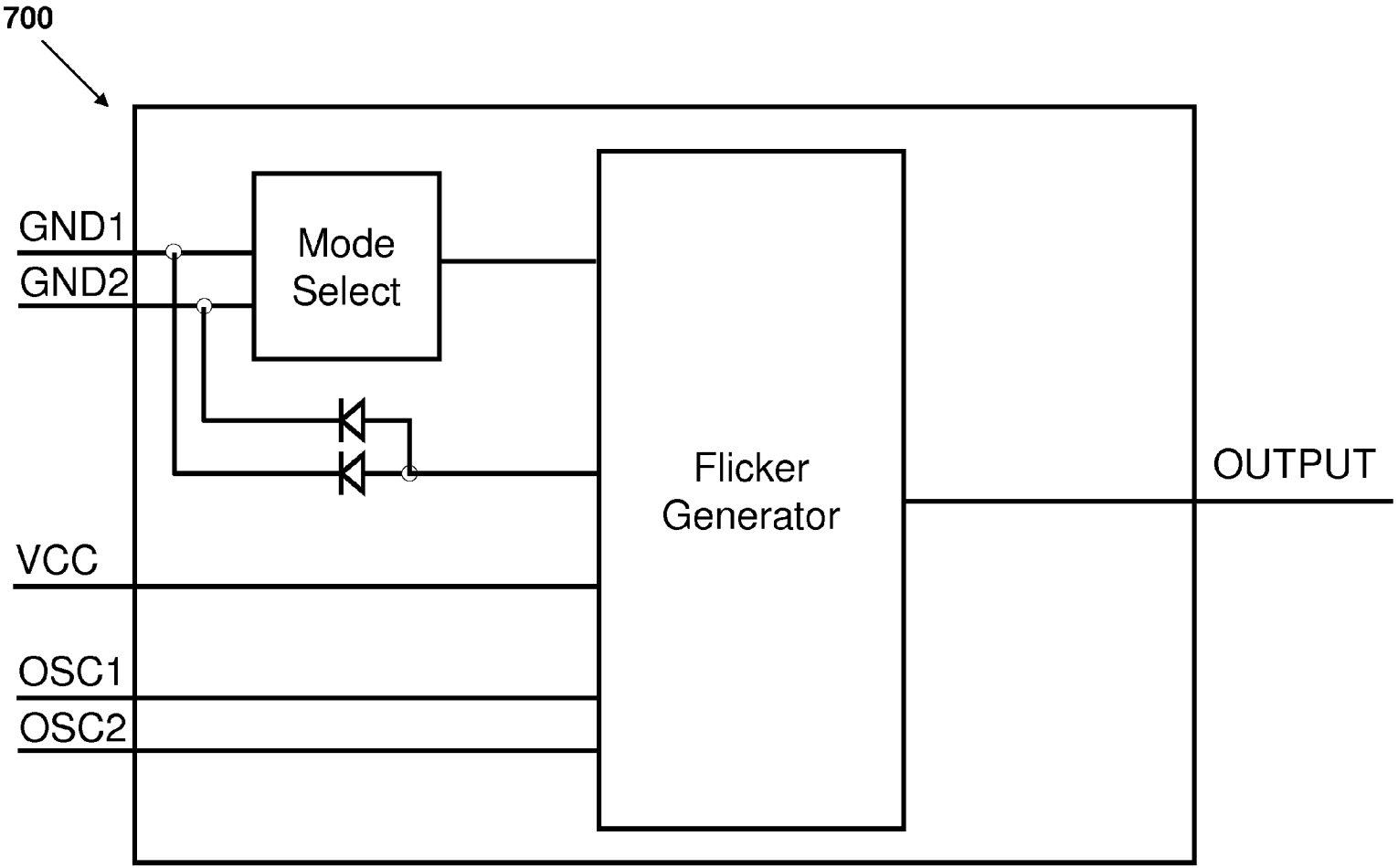
FIG. 7 shows a schematic illustration of an ASIC for use in a flameless candle circuit, according to an embodiment of the present invention.

FIG. 7 shows a schematic illustration of an ASIC 700 for use in a flameless candle circuit, according to an embodiment of the present invention. The ASIC 700 may be similar to ASIC 230. As shown, the ASIC has two ground terminals GND1 and GND2, as well as two oscillator inputs OSC1 and OSC2. Both ground terminals are connected to a single ground bus. As shown, both ground terminals are connected through two diodes, but other circuit designs are also possible. Power from current flow through one or both of GND1 and GND2 is supplied to the flicker generator, or any other component of the ASIC (for example, a component used for testing the ASIC) according to design preferences. The flicker generator may include additional components, such as dividers, decoders, volatile and/or non-volatile memories, comparators, timers, or the like. The mode of operation of the flicker generator may be determined through the mode select block according to whether current flows through GND1 and/or GND2.

Figure 6:
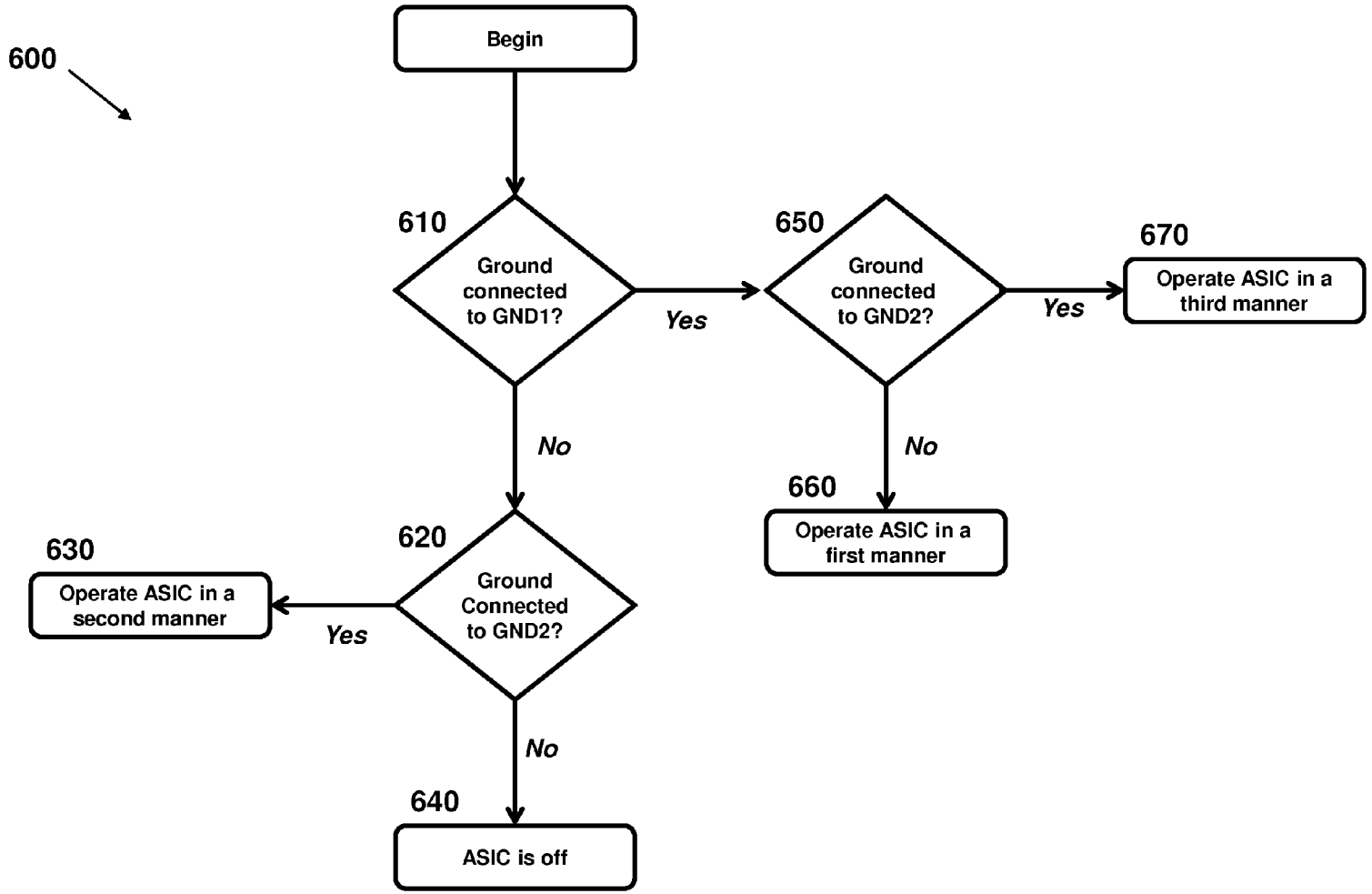
FIG. 6 shows a flowchart for a method of operating a flameless candle circuit, according to an embodiment of the present invention.

FIG. 6 shows a flowchart 600 for a method of operating a flameless candle circuit, according to an embodiment of the present invention. Some steps illustrated in the flowchart 600 may be performable in a different order, simultaneously, or some steps may be omitted according to preferences.

The flow begins and at step 610, the flow is routed step 650 if ground is connected to GND1. At step 650, the flow is routed to one of steps 660 or 670 according to whether ground is connected to GND2. If GND2 is not connected to ground, then the ASIC operates in a first manner—e.g., as described above in conjunction with circuit 500. If GND2 is connected to ground, then the ASIC operates in a third manner—e.g., as described above in conjunction with circuit 500.

Going back to step 610, the flow is routed step 620 if ground is not connected to GND1. At step 620, the flow is routed to one of steps 630 or 640 according to whether ground is connected to GND2. If ground is connected to GND2, then the flow proceeds to step 630 at which the ASIC is operated in a second manner—e.g., as described above in conjunction with circuit 500. If ground is not connected to GND2, then the flow proceeds to step 640 at which the ASIC is off—e.g., as described above in conjunction with circuit 500.

While the invention has been described with reference to certain embodiments, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiment disclosed, but that the invention will include all embodiments falling within the scope of the appended claims.

The invention claimed is:

1. A flameless candle circuit comprising:

an application-specific integrated circuit ("ASIC") including a first power terminal, a second power terminal, and an output;

a light emitting diode ("LED") configured to receive a signal from the output of the ASIC; and a single-pole switch configured to:

selectively provide a battery voltage to at least one of the first power terminal and the second power terminal, and selectively remove the battery voltage from both the first power terminal and the second power terminal to turn the ASIC off; and wherein the ASIC is configured to:

drive the LED in a first mode when the battery voltage is provided to the first power terminal, and drive the LED in a second mode when the battery voltage is provided to the second power terminal.

2. The flameless candle circuit of claim 1, wherein the ASIC is configured to constantly provide a flickering signal to the LED in the first mode.

3. The flameless candle circuit of claim 1, wherein the ASIC is further configured to intermittently provide a flickering signal to the LED according to a slow timer in the second mode.

4. The flameless candle circuit of claim 3, wherein the slow timer comprises a repeating 24-hour cycle timer.

5. The flameless candle circuit of claim 4, wherein the ASIC is further configured to provide a flickering signal for 5 hours and turn off the flickering signal for 19 hours during one cycle of the repeating 24-hour cycle.

6. The flameless candle circuit of claim 3 wherein the ASIC is further configured to drive the LED in a third mode when the battery voltage is provided to both the first power terminal and the second power terminal.

7. The flameless candle circuit of claim 6, wherein the ASIC is further configured to intermittently provide a signal to the LED according to a fast timer in the third mode.

8. The flameless candle circuit of claim 7, wherein the ASIC is further configured to cause the LED to blink for a predetermined number of times during a predetermined period of time such that an accuracy of the slow timer can be determined in the third mode.

9. The flameless candle circuit of claim 1, wherein the single-pole switch comprises a single-pole, triple-throw switch including three positions; and wherein the single-pole switch is further configured to:

provide the battery voltage to the first power terminal but not the second power terminal of the ASIC when the switch is in the first position, provide the battery voltage to the second power terminal but not the first power terminal of the ASIC when the switch is in the second position, and remove the battery voltage from the first power terminal and the second power terminal of the ASIC when the switch is in the third position.

10. The flameless candle of claim 9, wherein the single-pole switch comprises a slide switch.

11. The flameless candle of claim 9, wherein the single-pole switch includes an input terminal configured to receive the battery voltage, a first output terminal electrically connected to the first power terminal of the ASIC, and a second output terminal electrically connected to the second power terminal of the ASIC.

12. A method for operation of a flameless candle circuit, the method comprising:

operating an application-specific integrated circuit ("ASIC") in a first manner by using a single-pole switch to apply a battery voltage to a first power terminal of the ASIC, and remove the battery voltage from a second power terminal of the ASIC;

driving an LED in a first mode while operating the ASIC in the first manner;

operating the ASIC in a second manner by using the single-pole switch to apply the battery voltage to the second power terminal of the ASIC, and remove the battery voltage from the first power terminal of the ASIC;

driving an LED in a second mode while operating the ASIC in the second manner; and turning off the flameless candle circuit by using the single-pole switch to remove the battery voltage from the first power terminal of the ASIC, and remove the battery voltage from the second power terminal of the ASIC.

13. The method of claim 12, wherein said driving an LED in a first mode further comprises constantly providing a flickering signal from the ASIC to the LED.

14. The method of claim 12, said driving the LED in a second mode further comprises intermittently providing a flickering signal from the ASIC to the LED.

15. The method of claim 14, operating a cycle of the slow timer over 24 hours and subsequently repeating the cycle.

16. The method of claim 15, further comprising:

providing a flickering signal from the ASIC to the LED for approximately 5 hours during the cycle; and turning off the flickering signal from the ASIC to the LED for approximately 19 hours during the cycle.

17. The method of claim 12, further comprising operating the ASIC in a third manner by applying the battery voltage to both the first power terminal and the second power terminal of the ASIC;

driving the LED in a third mode while operating the ASIC in the third manner.

18. The method of claim 17, wherein said driving the LED in a third mode further comprises intermittently providing a signal from the ASIC to the LED according to a fast timer.

19. The method of claim 17, wherein said driving the LED in a third mode further comprises blinking the LED for a predetermined number of times during a predetermined period of time to determine an accuracy of the slow timer.

20. The method of claim 12, wherein the single-pole switch comprises a single-pole, triple-throw switch, and wherein:

said operating an ASIC in a first manner further comprises switching the single-pole, triple-throw switch into a first position, said operating an ASIC in a second manner further comprises switching the single-pole, triple-throw switch into a second position, and said turning off the flameless candle circuit further comprises switching the single-pole, triple-throw switch into a third position.

21. A flameless candle circuit comprising:

an application-specific integrated circuit ("ASIC") including a first ground terminal, a second ground terminal, and an output;

a light emitting diode ("LED") configured to receive a signal from the output of the ASIC; and a single-pole switch configured to:

selectively connect ground to at least one of the first ground terminal and the ground power terminal, and selectively disconnect ground from both the first ground terminal and the second ground terminal to turn the ASIC off; and wherein the ASIC is configured to:

drive the LED in a first mode when the first ground terminal is grounded, and drive the LED in a second mode when the second ground terminal is grounded.

22. The flameless candle circuit of claim 21, wherein the ASIC is configured to constantly provide a flickering signal to the LED in the first mode.

23. The flameless candle circuit of claim 21, wherein the ASIC is further configured to intermittently provide a flickering signal to the LED according to a slow timer in the second mode.

24. The flameless candle circuit of claim 23, wherein the slow timer comprises a repeating 24-hour cycle timer.

25. The flameless candle circuit of claim 24, wherein the ASIC is further configured to provide a flickering signal for 5 hours and turn off the flickering signal for 19 hours during one cycle of the repeating 24-hour cycle.

26. The flameless candle circuit of claim 23 wherein the ASIC is further configured to drive the LED in a third mode when ground is connected to both the first ground terminal and the second ground terminal.

27. The flameless candle circuit of claim 26, wherein the ASIC is further configured to intermittently provide a signal to the LED according to a fast timer in the third mode.

28. The flameless candle circuit of claim 27, wherein the ASIC is further configured to cause the LED to blink for a predetermined number of times during a predetermined period of time such that an accuracy of the slow timer can be determined in the third mode.

29. The flameless candle circuit of claim 21, wherein the single-pole switch comprises a single-pole, triple-throw switch including three positions; and wherein the single-pole switch is further configured to:

connect ground to the first ground terminal but not the second ground terminal of the ASIC when the switch is in the first position, connect ground to the second ground terminal but not the first ground terminal of the ASIC when the switch is in the second position, and disconnect ground from the first ground terminal and the second ground terminal of the ASIC when the switch is in the third position.

30. The flameless candle of claim 29, wherein the single-pole switch comprises a slide switch.

31. The flameless candle of claim 29, wherein the single-pole switch includes an input terminal connected to ground, a first output terminal electrically connected to the first ground terminal of the ASIC, and a second output terminal electrically connected to the second ground terminal of the ASIC.

32. A method for operation of a flameless candle circuit, the method comprising:

operating an application-specific integrated circuit ("ASIC") in a first manner by using a single-pole switch to connect ground to a first ground terminal of the ASIC, and disconnect ground from a second ground terminal of the ASIC;

driving an LED in a first mode while operating the ASIC in the first manner;

operating the ASIC in a second manner by using the single-pole switch to connect ground to the second ground terminal of the ASIC, and to disconnect ground from the first ground terminal of the ASIC;

driving an LED in a second mode while operating the ASIC in the second manner; and turning off the flameless candle circuit by using the single-pole switch to disconnect ground from the first ground terminal of the ASIC, and disconnect ground from the second ground terminal of the ASIC.

33. The method of claim 32, wherein said driving an LED in a first mode further comprises constantly providing a flickering signal from the ASIC to the LED.

34. The method of claim 32, said driving the LED in a second mode further comprises intermittently providing a flickering signal from the ASIC to the LED.

35. The method of claim 34, operating a cycle of the slow timer over 24 hours and subsequently repeating the cycle.

36. The method of claim 35, further comprising:

providing a flickering signal from the ASIC to the LED for approximately 5 hours during the cycle; and turning off the flickering signal from the ASIC to the LED for approximately 19 hours during the cycle.

37. The method of claim 32, further comprising operating the ASIC in a third manner by connecting ground to both the first ground terminal and the second ground terminal of the ASIC;

driving the LED in a third mode while operating the ASIC in the third manner.

38. The method of claim 37, wherein said driving the LED in a third mode further comprises intermittently providing a signal from the ASIC to the LED according to a fast timer.

39. The method of claim 37, wherein said driving the LED in a third mode further comprises blinking the LED for a predetermined number of times during a predetermined period of time to determine an accuracy of the slow timer.

40. The method of claim 32, wherein the single-pole switch comprises a single-pole, triple-throw switch, and wherein:

said operating an ASIC in a first manner further comprises switching the single-pole, triple-throw switch into a first position, said operating an ASIC in a second manner further comprises switching the single-pole, triple-throw switch into a second position, and said turning off the flameless candle circuit further comprises switching the single-pole, triple-throw switch into a third position.

* * * * *